US010969738B2

(12) United States Patent
Hatazaki

(10) Patent No.: US 10,969,738 B2
(45) Date of Patent: Apr. 6, 2021

(54) RECORDING MATERIAL COOLING DEVICE

(71) Applicant: CANON KABUSHIKI KAISHA, Tokyo (JP)

(72) Inventor: Kazunari Hatazaki, Moriya (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 16/881,264

(22) Filed: May 22, 2020

(65) Prior Publication Data

US 2020/0285193 A1 Sep. 10, 2020

Related U.S. Application Data

(63) Continuation of application No. PCT/JP2018/044102, filed on Nov. 22, 2018.

(30) Foreign Application Priority Data

Nov. 24, 2017 (JP) ..... JP2017-225561

(51) Int. Cl.
*G03G 15/00* (2006.01)
*G03G 21/20* (2006.01)

(52) U.S. Cl.
CPC ..... *G03G 21/20* (2013.01); *G03G 15/6529* (2013.01); *G03G 15/6573* (2013.01)

(58) Field of Classification Search
CPC ..... G03G 15/6529; G03G 15/6573; G03G 15/6585; G03G 21/20
See application file for complete search history.

(56) References Cited

U.S. PATENT DOCUMENTS

2006/0039725 A1 2/2006 Wu et al.
2009/0103959 A1* 4/2009 Koyama ..... G03G 15/6573 399/341

(Continued)

FOREIGN PATENT DOCUMENTS

JP 2012-98677 A 5/2012
JP 2013-24912 A 2/2013

(Continued)

OTHER PUBLICATIONS

Machine translation of JP 2012-098677A (published on May 24, 2012) printed on Sep. 8, 2020.*

(Continued)

*Primary Examiner* — Sophia S Chen
(74) *Attorney, Agent, or Firm* — Venable LLP

(57) ABSTRACT

To improve heat dissipation efficiency by a heat dissipating portion relative to a heat receiving portion contacting an inner peripheral surface of belts while effectively utilizing spaces in the belts forming a nip in which a recording material is cooled, where heat sinks 53 and 54 are disposed on and under upper and lower belts 51 and 52, heat absorbing portions 53*a* and 53*b* (contact portions with the belts) are provided by being shifted in a sheet feeding direction so as not to contact each other through the belts, but heat discharging portions 53*c*, 53*d*, 54*c*, and 54*d* are disposed in an extended manner so as to overlap with the heat absorbing portions on opposite sides. Thus, it becomes possible to enhance heat dissipation efficiency in spaces in limited belt cross sections, and to meet downsizing and speed-up of the device.

11 Claims, 5 Drawing Sheets

(56) References Cited

U.S. PATENT DOCUMENTS

| | | | | |
|---|---|---|---|---|
| 2013/0121739 | A1* | 5/2013 | Hatazaki | G03G 15/2021 399/341 |
| 2014/0186080 | A1* | 7/2014 | Ikeda | G03G 15/6529 399/341 |
| 2014/0308057 | A1* | 10/2014 | Tomino | G03G 15/6573 399/341 |
| 2017/0269548 | A1* | 9/2017 | Kutsuwada | G03G 21/20 |

FOREIGN PATENT DOCUMENTS

| | | | |
|---|---|---|---|
| JP | 2013-114094 | A | 6/2013 |
| JP | 2013-235135 | A | 11/2013 |

OTHER PUBLICATIONS

International Search Report and Written Opinion, dated Jan. 8, 2019, in International Patent Application No. PCT/JP2018/044102.

* cited by examiner

RECORDING MATERIAL COOLING DEVICE

CROSS-REFERENCE TO RELATED APPLICATIONS

This application is a Continuation of International Patent Application No. PCT/JP2018/044102 filed Nov. 22, 2018, which claims the benefit of Japanese Patent Application No. 2017-225561 filed Nov. 24, 2017. The foregoing applications are incorporated herein by reference in their entireties.

TECHNICAL FIELD

The present invention relates to a recording material cooling device mounted in an image forming apparatus.

BACKGROUND ART

The image forming apparatus forms an image on a recording material by using, for example, an image forming process such as an electrophotographic process, an electrostatic recording process or a magnetic recording process. For example, the image forming apparatus includes a copying machine, a printer (laser beam printer, LED printer or the like), a facsimile machine, a multi-function machines of these, a word processor, and the like.

The recording material (sheet) is a material on which a developer image (hereinafter, referred to as a toner image) is formed by the image forming apparatus includes, for example, plain paper, thick paper, an envelope, a seal, a resin sheet, an overhead projector sheet (OHT sheet), and the like. Hereinafter, the recording material is referred to as a sheet.

As a conventional image forming apparatus such as the printer or the copying machine, the image forming apparatus in which the toner image formed by an electrophotographic recording type (process) is transferred onto the sheet, and thereafter the toner image is fixed by a fixing device has been well known. In the fixing device of such a type, for example, a fixing process is performed by causing the sheet to pass through a fixing nip formed by press-contacting a fixing member to be heated and a pressing member to each other.

In such an image forming apparatus, toner is made high recording material by applying heat to the sheet and thus is fixed on the sheet, and therefore sheets are successively stacked on a sheet discharge portion in a state in which the sheets are not sufficiently cooled, the sheets are bonded to each other by the toner in some instances.

In Japanese Laid-Open Patent Application (JP-A) 2012-098677, a constitution in which a water pipe is passed through a belt cooling member and a radiator is provided outside the image forming apparatus, and a heat dissipating portion is provided outside a belt and thus the sheet after fixing is cooled has been disclosed. Further, a constitution in which a pressing roller is provided at a position opposing the cooling member through the belt and the belt is press-contacted to the cooling member has been disclosed.

However, as in JP-A 2012-098677, in the case of the constitution in which the water pipes is passed through the belt cooling member, the radiator is disposed outside the image forming apparatus, and the heat dissipating portion is disposed outside the belt, a space for disposing the radiator outside the image forming apparatus is required.

Therefor, a constitution in which the cooling member is a heat sink, and the heat sink is provided inside each of upper and lower belts would be considered.

However, when the upper and lower heat sinks are disposed by being shifted so as not to overlap with each other with respect to the sheet feeding direction, the following space becomes a dead space, so that there is a liability that spaces in the upper and lower belts cannot be effectively utilized.

The following space refers to, in the space in the upper belt, a space opposing, through the upper and lower belts, a region in which the heat sink in the lower belt contacts an inner peripheral surface of the lower belt. And/or, the following space refers to, in the space in the lower belt, a space opposing, through the upper and lower belts, a region in which the heat sink in the upper belt contacts an inner peripheral surface of the upper belt.

Therefore, an object of the present invention is to improve heat dissipation efficiency by a heat dissipating portion relative to a heat receiving portion contacting the inner peripheral surface of the belt while effectively utilizing the spaces in the belts forming the nip in which the recording material is cooled.

SUMMARY OF THE INVENTION

A representative constitution of a recording material cooling device according to the present invention for achieving the above-described object comprises: an endless rotatable first belt; an endless rotatable second belt for forming a nip in which a recording material in a state that the recording material passed through an image heating portion and is heated is cooled by being nipped and fed in cooperation with the first belt; a first cooling member provided inside the first belt and including a first heat receiving portion for receiving heat in contact with an inner surface of the first belt in the nip and a first heat dissipating portion for dissipating the heat; and a second cooling member provided inside the second belt and including a second heat receiving portion for receiving heat in contact with an inner surface of the second belt in the nip and a second heat dissipating portion for dissipating the heat, wherein with respect to a recording material feeding direction in the nip, in a section in which the first heat receiving portion contacts the inner surface of the first belt, the second heat receiving portion is absent in the second cooling member opposing the first heat receiving portion while sandwiching the first belt and the second belt, wherein the first heat dissipating portion is longer than the first heat receiving portion and the second heat dissipating portion is longer than the second heat receiving portion, with respect to the recording material feeding direction, and wherein the first heat dissipating portion overlaps with the second heat receiving portion and the second heat dissipating portion overlaps with the first heat receiving portion, with respect to the recording material feeding direction.

EMBODIMENTS FOR CARRYING OUT THE INVENTION

Embodiment 1

[Image Forming Portion]

Figure 5:
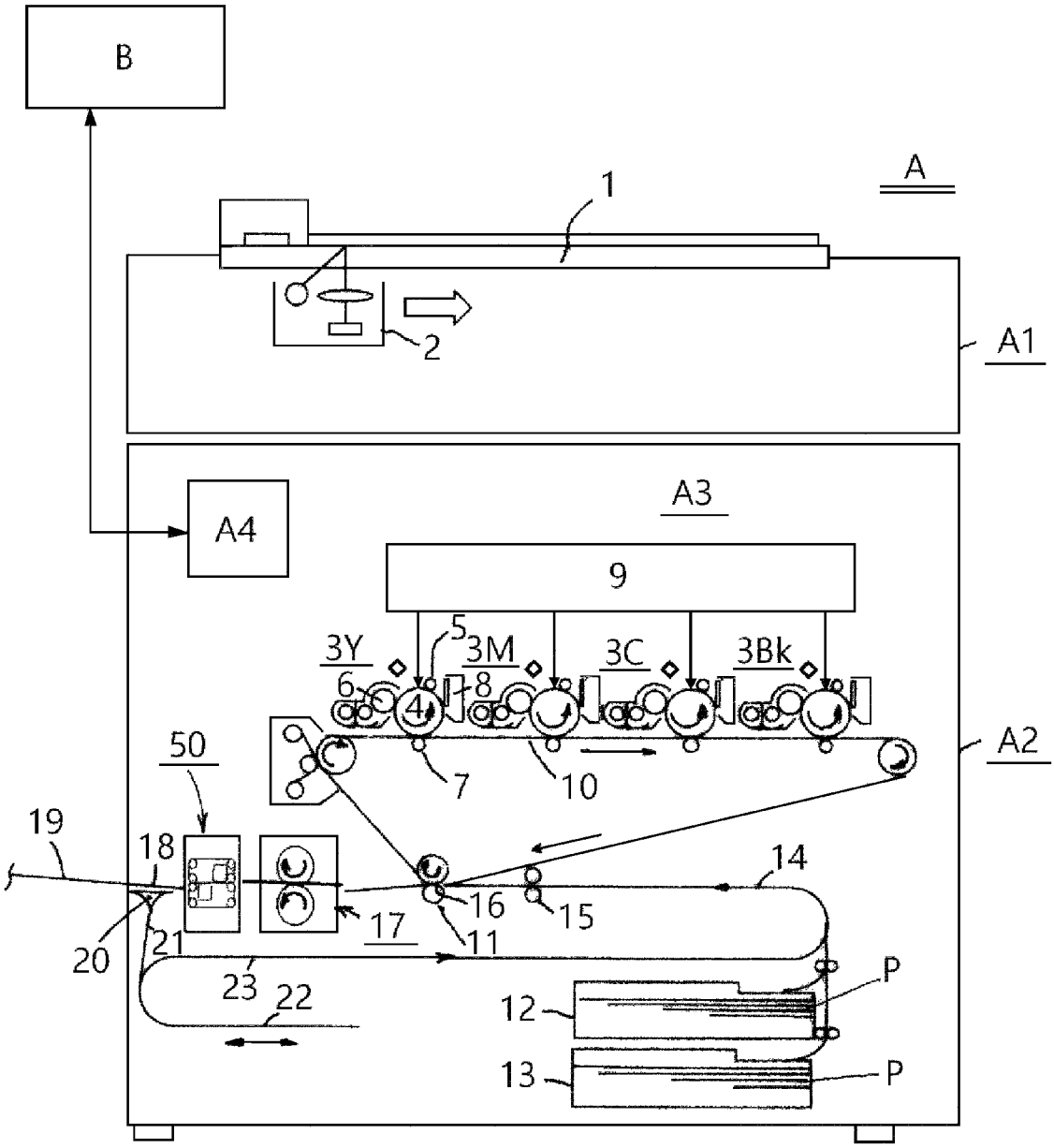
FIG. 5 is a structural illustration of an example of an image forming apparatus.

FIG. 5 is a schematic view showing a general structure of an image forming apparatus A in this embodiment and shows a full-color electrophotographic copying machine of an intermediary transfer type-tandem type. This copying machine A is capable of forming a full-color or monochromatic toner image on a sheet (recording material) P by an image forming operation of an image forming portion A3 in an apparatus main assembly A2 on the basis of image information inputted from an image reading apparatus A1 or an external apparatus B such as a print server to a controller A4. The controller A4 effects integrated control of the image forming apparatus A. The image reading apparatus A1 photoelectrically reads an image of an original placed on an original platen glass 1, by a movable optical system unit 2.

In the apparatus main assembly A2, the image forming portion A3 for forming a toner image on the sheet P includes four image forming units 3 (Y, M, C, Bk) for forming color toner images of yellow (Y), magenta (M), cyan (C) and black (Bk). Each of the image forming units 3 includes electrophotographic process devices such as a photosensitive drum (hereinafter, referred to as a drum) 4, a charger 5, a developing device 6, a primary transfer roller 7, a drum cleaner 8 and the like. Incidentally, in order to avoid complication of the figure, indication of symbols for the devices in the image forming units 3M, 3C, and 3Bk other than the image forming unit 3Y were omitted.

Further, the image forming portion A3 includes a laser scanner 9 for subjecting the respective drums 4 to scanning exposure and an intermediary transfer belt 10 for carrying and feeding the toner images transferred from the respective drums 4 by the primary transfer rollers 7. Further, the image forming portion A3 includes a secondary transfer roller 11 for transferring the toner images from the intermediary transfer belt 10 onto the sheet P. The electrophotographic process and the image forming operation of the above-described image forming portion A3 are well known and therefore will be omitted from detailed description.

A single sheet P is separated and fed from a cassette 12 or 13 at predetermined control timing and passes through a feeding path 14, and is introduced into a secondary transfer nip 16 formed by the intermediary transfer belt 10 and the secondary transfer roller 11 at predetermined control timing by a registration roller pair 15. The sheet P is subjected to secondary transfer of the toner images from the intermediary transfer belt 10 side in a process in which the sheet P is nipped and fed in the secondary transfer nip 16. Then, the sheet P is separated from the intermediary transfer belt 10 side and is introduced into a fixing device (image heating portion) 17, in which the toner images on the sheet P are heat-fixed as fixed images.

The fixing device 17 includes, for example, a fixing member (a heat-fixing roller or film or the like) to be heated and a pressing member (a roller or a film or the like), and is an image heating apparatus for fixing the toner images while nipping and feeding the sheet P in a fixing nip formed by press-contact of both the members. In this embodiment, the fixing device 17 is a fixing device of a heating roller type. The sheet P coming out of the fixing device 17 is subsequently introduced and cooled in a recording material cooling device (hereinafter, referred to as a cooling device) 50. Then, in the case of a one-side print job, the sheet P which is cooled by the cooling device 50 and which has been subjected to one side printing passes through a feeding path 18 and is sent onto a discharge tray 19.

In the case of a double-side print job, the sheet P coming out of the cooling device 50 is changed in course toward a feeding path 21 side by control of a flapper 20 and is introduced into a reverse feeding path 22. Then, the sheet P is introduced into a re-feeding path 23 by being fed in a switch-back manner, and is introduced again into the feeding path 14 in a state in which the sheet P is turned upside down. Thereafter, the sheet P is fed along passages of the registration roller pair 15, the secondary transfer nip 16, the fixing device 17, the cooling device 50, and the feeding path 18 similarly as during the one-side printing, and is sent as a double-side print onto the discharge tray 19.

[Cooling Device]

Figure 1:
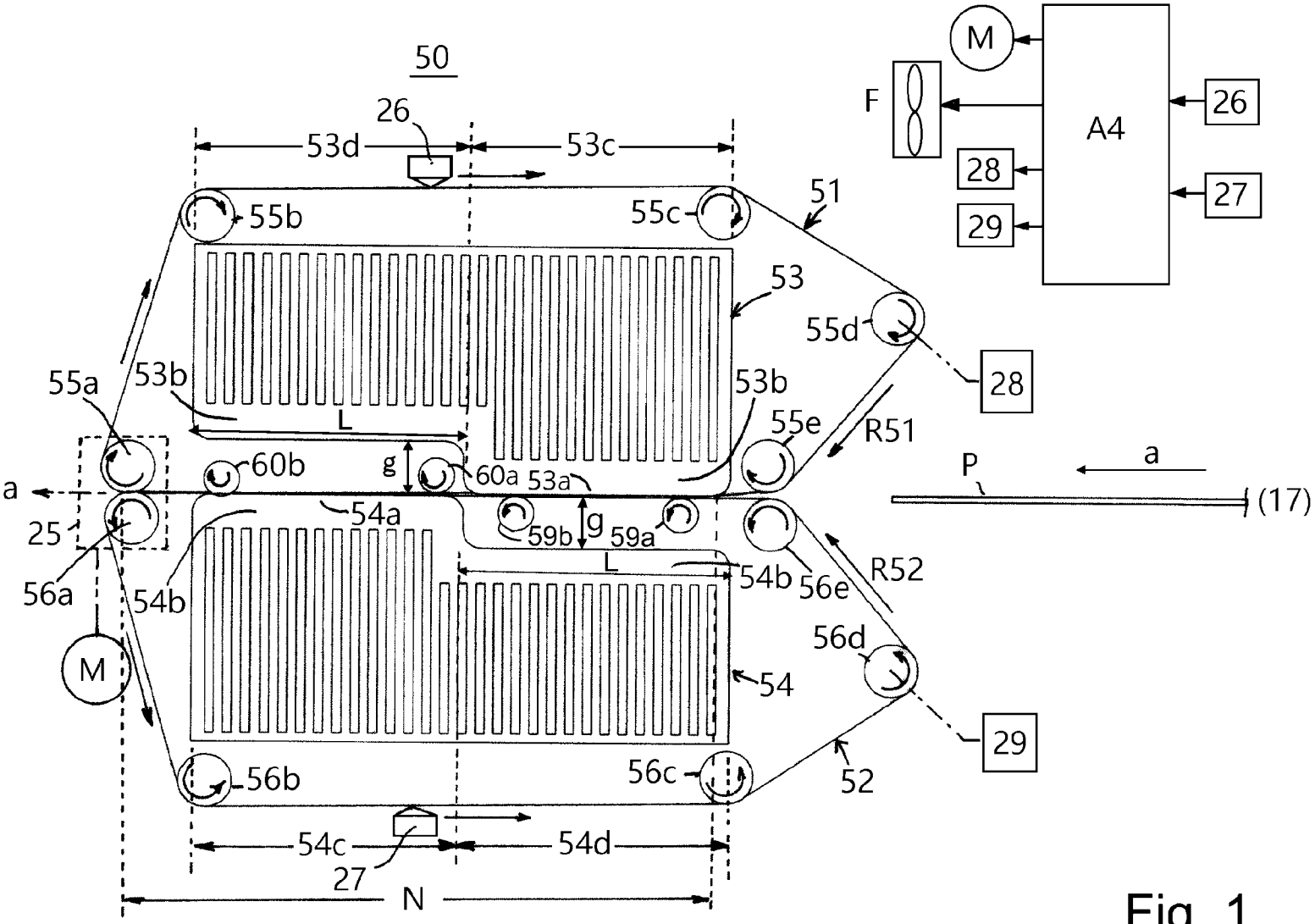
FIG. 1 is a structural illustration of a cooling device of an embodiment 1.

FIG. 1 is a structural illustration of the cooling device 50 in this embodiment. The sheet P put in a state in which the sheet P passed through the fixing device 17 and was heated is about 70° C. in temperature immediately in front of the cooling device 50 and is cooled to about 50° C. by passing through the cooling device 50.

This cooling device 50 includes a rotatable first belt (hereinafter, referred to as an upper belt) 51 which has an endless shape and flexibility. Further, the cooling device 50 includes a rotatable second belt (hereinafter, referred to as a lower belt) 52 which forms a nip in which the sheet P put in the heated state by being passed through the fixing device 17 is cooled by being nipped and fed in cooperation with the upper belt 51 and which has an endless shape and flexibility. In this embodiment, the upper and lower belts 51 and 52 are made of polyimide and are set at 100 μm in thickness, and a peripheral length of each belt is 942 mm. The nip N is set so as to be broad in a predetermined manner in a sheet feeding direction (recording material feeding direction) a.

The sheet P nipped and fed in the nip N is cooled through the respective belts 51 and 52 by a first cooling member (hereinafter, referred to as an upper heat sink) 53 provided inside the upper belt 51 and a second cooling member (hereinafter, referred to as a lower heat sink) 54 provided inside the lower belt 52.

The upper belt 51 is extended and stretched between first to fifth parallel fine rotatable supporting rollers 55*a* and 55*e* (a plurality of belt supporting members) provided in a predetermined manner with predetermined intervals successively with each other with respect to a belt rotational direction R51.

In this embodiment, the first supporting roller 55*a* is positioned as a driving roller, for the upper belt 51 on a sheet exit side of the nip N. Hereinafter, this first supporting roller 55*a* is referred to as the driving roller. Further, the fifth supporting roller 55*e* is positioned on a sheet entrance side of the nip N. Hereinafter, this fifth supporting roller 55*e* is referred to as an entrance-side roller. Further, the fourth supporting roller 55*d* is a steering roller also functions as a tension roller for imparting tension to the upper belt 51. Hereinafter, this fourth supporting roller 55*d* is referred to as the steering roller.

The lower belt 51 is also extended and stretched between first to fifth parallel fine rotatable supporting rollers 56*a* and 56*e* provided in a predetermined manner with predetermined intervals successively with each other with respect to a belt rotational direction R52.

In this embodiment, the first supporting roller 56*a* is positioned as a driving roller, for the lower belt 52 on a sheet exit side of the nip N. Hereinafter, this first supporting roller 56*a* is referred to as the driving roller. Further, the fifth supporting roller 56*e* is positioned on a sheet entrance side of the nip N. Hereinafter, this fifth supporting roller 56*e* is referred to as an entrance-side roller. Further, the fourth supporting roller 56*d* is a steering roller also functions as a tension roller for imparting tension to the lower belt 52. Hereinafter, this fourth supporting roller 56*d* is referred to as the steering roller.

The respective entrance-side rollers 55*e* and 56*e* of the upper belt 51 and the lower belt 52 are brought near to and opposed to each other in a predetermined manner through the upper belt 51 and the lower belt 52. Further, the driving rollers 55*a* and 56*a* of the upper belt 51 and the lower belt 52 are press-contacted to each other in a predetermined manner through the upper belt 51 and the lower belt 52. By this, a broad nip N is formed in a predetermined manner with respect to the sheet feeding direction a by a belt portion of the upper belt 51 between the entrance-side roller 55*e* and the driving roller 55*a* and a belt portion of the lower belt 52 between the entrance-side roller 56*e* and the driving roller 56*a*.

Each of the driving rollers 55*a* and 56*a* for rotationally driving the upper and lower belts 51 and 52 has an outer diameter φ of 40 mm and includes a rubber layer of 1 mm in thickness as a surface layer. The driving roller 55*a* is a stationary roller. Against this driving roller 55*a*, the driving roller 56*a* is pressed at about 49 N (about 5 kgf) through the upper belt 51 and the lower belt 52.

The driving rollers 55*a* and 56*a* are connected to a single motor (driving source) M controlled by a controller A4 through a driving gear mechanism 25 and is driven in a predetermined direction at a predetermined rotational speed of rotation of the motor M. By this, the upper belt 51 and the lower belt 52 are driven in directions of the arrows R51 and R52, respectively, at a predetermined rotational speed.

The steering rollers 55*d* and 56*d* of the upper and lower belts 51 and 52 are rollers for controlling shift movement of the upper belt 51 and the lower belt 52, respectively, in a widthwise direction during rotation, and each includes a 1 mm-thick rubber layer as a surface layer.

Both the steering rollers 55*d* and 56*d* are urged by springs in directions of imparting tension to the upper belt 51 and the lower belt 52, respectively, and spring pressure is set so that tension of each of the belts 51 and 52 is about 39.2 N (about 4 kgf).

Shift movement amounts of the upper belt 51 and the lower belt 52 in the widthwise direction during the rotation are detected by detecting mechanisms 26 and 27, respectively, and pieces of detection information (electrical information) are inputted to the controller A4. The controller A4 controls roller swing mechanisms 28 and 29 on the basis of the inputted detection information and causes the steering rollers 55*d* and 56*d* to swing in a predetermined manner, and thus controls the mechanisms 28 and 29 so that each of the upper belt 51 and the lower belt 52 falls within a predetermined shift movement range (swing-type control).

That is, the controller A4 controls meandering of the belts 51 and 52 in a predetermined range by forming rubber angles for the respective steering rollers 55*d* and 56*d* with longitudinal centers of the rollers as rotation fulcrums by the roller swing mechanisms 28 and 29, respectively.

The upper heat sink 53 disposed inside the upper belt 51 and the lower heat sink 54 disposed inside the lower belt 52 are aluminum in material. The upper heat sink 53 includes a heat receiving portion (first heat receiving portion) 53*a* for receiving heat from the belt 51 in contact with an inner surface of the upper belt 51 in the nip N and includes heat dissipating (radiating) portions (first heat dissipating portions) 53*c* and 53*d* for dissipating the heat. The lower heat sink 54 also includes a heat receiving portion (second heat receiving portion) 54*a* for receiving heat from the belt 52 in contact with an inner surface of the lower belt 51 in the nip N and includes heat dissipating portions (second heat dissipating portions) 54*c* and 54*d* for dissipating the heat.

In the upper and lower heat sinks 53 and 54, in order to ensure contact area with the air, the respective heat dissipating portions 53*c*, 53*d*, 54*c* and 54*d* erect fins with fine pitches. A fin thickness is 1 mm, a fin pitch is 5 mm, and a fin height is 100 mm. Further, a thickness of each of fin bases 53*b* and 54*b* for transporting the heat from the respective heat receiving portions 53*a* and 54*a* to heat dissipating (radiating) fins (heat dissipating portions 53*c*, 53*d*, 54*c*, 54*d*) is set at 10 mm.

Further, a fan F controlled by the controller A4 is provided for forcedly sending the air to the heat dissipating portions 53*c*, 53*d*, 54*c* and 54*d*, and a flow rate of the air sent to the heat dissipating portions 53*c*, 53*d*, 54*c* and 54*d* is 2 $m^3$/min.

Further, as regards the upper-side heat sink 53, a length of the heat receiving portion 53*a* is 100 mm in the sheet feeding direction a. Further, as regards the lower-side heat sink 54, a length of the heat receiving portion 54*a* is 100 mm in the sheet feeding direction a.

When the nip N by the upper and lower belts 51 and 52 is seen along the sheet feeding direction a, between the heat receiving portion 53*a* and the heat receiving portion 54*a*, a clearance of about 3 mm is formed with respect to the sheet feeding direction a. By this, the heat receiving portions 53*a* and 54*a* of the upper and lower heat sinks 53 and 54 are prevented from contacting each other through the belts 51 and 52.

That is, with respect to the sheet feeding direction a in the nip N, in a section where the heat receiving portion 53*a* of the upper heat sink 53 contacts the inner surface of the upper belt 51, the lower heat sink 54 does not contact the lower belt 52 in a position opposing the heat receiving portion 53*a* through the upper belt 51 and the lower belt 52.

In other words, with respect to the sheet feeding direction a in the nip N, in the section where the heat receiving portion 53*a* of the upper heat sink 53 contacts the inner surface of the upper belt 51, the heat receiving portion 54*a* of the lower heat sink 54 does not present in the position opposing the heat receiving portion 53*a* through the upper and lower belts 51 and 52.

Here, the heat receiving portions 53*a* and 54*a* of the upper and lower heat sinks 53 and 54 are made of metal. For that reason, it is difficult to manufacture surfaces of the heat receiving portions 53*a* and 54*a* of the upper and lower heat sinks 53 and 54 with uniform surface accuracy so that their surfaces uniformly contact each other in their entirety. Accordingly, when the upper and lower belts 51 and 52 are sandwiched in the same region of the nip N by the upper and lower heat sinks 53 and 54 which are made of metal, there is a liability that a high-pressure portion is locally formed depending on the surface accuracy of contact surfaces of the heat sinks 53 and 54 with the upper and lower belts 51. In this case, there is a liability that early abrasion (wearing) of the belts 51 and 52 at this high-pressure portion.

Therefore, in the cooling device 50 of this embodiment, the heat sinks 53 and 54 are prevented from nipping the upper and lower belts 51 and 52 therebetween in the nip N. Specifically, the heat receiving portion 53*a* on the upper heat sink 53 side and the heat receiving portion 54*a* on the lower heat sink 54 side are disposed by providing a predetermined clearance between the heat receiving portion 53*a* and the heat receiving portion 54*a* with respect to the sheet feeding direction a. In order to more reliably prevent contact between the heat receiving portion 53*a* and the heat receiving portion 54*a* while taking a tolerance of assembling or the like into consideration, this clearance may more preferably be provided so as to be 2 mm or more with respect to the sheet feeding direction a.

Figure 2:
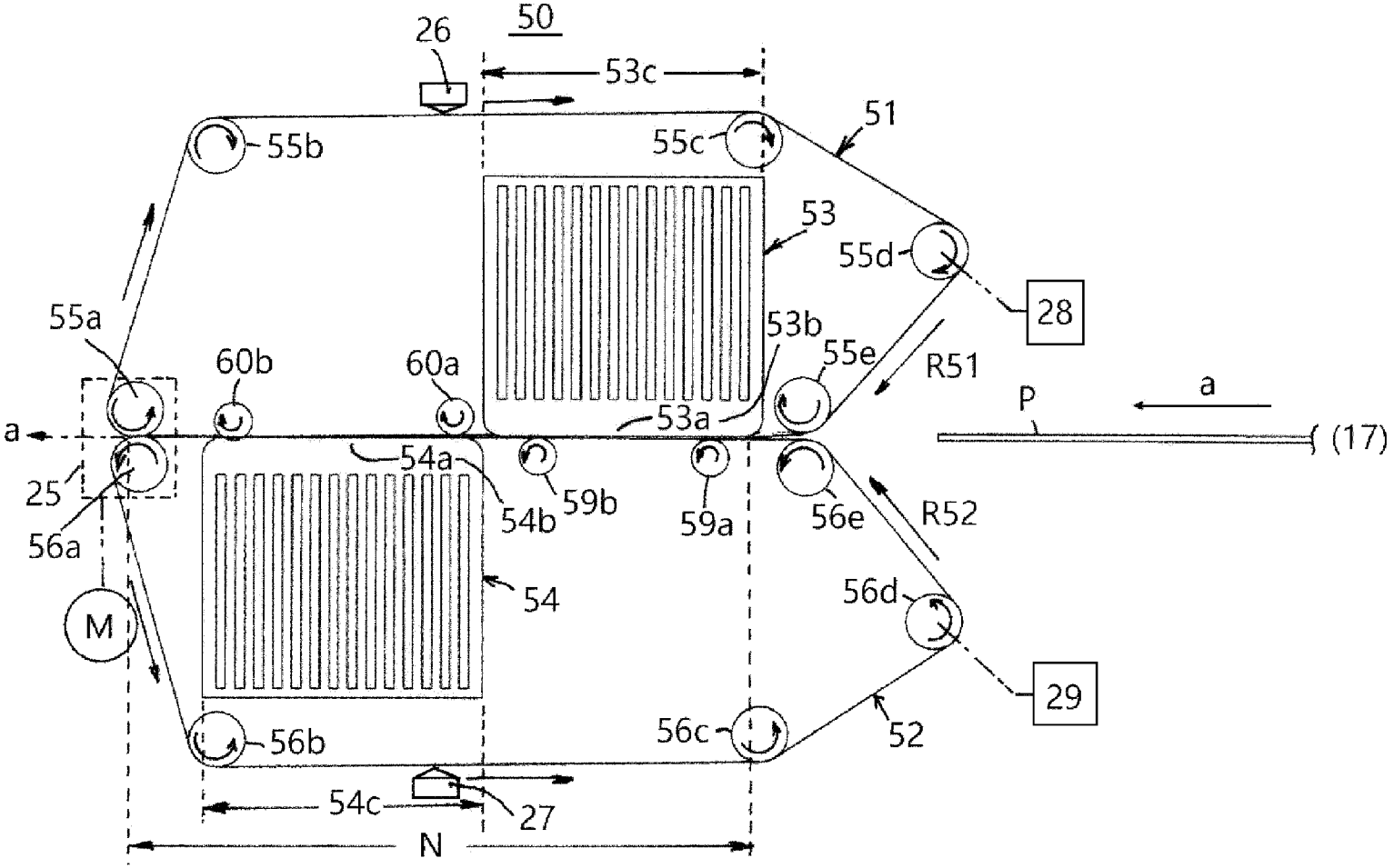
FIG. 2 is a structural illustration of a cooling device of a reference example.

In the case where the heat sinks 53 and 54 are disposed by being shifted from each other so as not to contact each other, it would be simply considered that arrangement as shown in a reference view of FIG. 2.

However, in the arrangement in the reference view of FIG. 2, a cross-sectional area of the heat sink 53 merely occupies about 30% of a cross-sectional area of an inner peripheral surface of the belt 51, so that a space in the upper belt 51 cannot be efficiently used.

Here, the cross-sectional area refers to an area in a cross-sectional view of the cooling device 50 as seen in a plane which passes through a center of a region in which the sheet is capable of being fed with respect to a rotational axis direction of the driving roller 55*a* of the upper belt 51 and which is perpendicular to a rotational axis of the driving roller 55*a*. The cross-sectional area of the belt is an area in a belt locus in a state in which the upper belt 51 is stretched in this cross-sectional view.

Further, in the arrangement of the reference example of FIG. 2, a relationship between an cross-sectional area of an inner peripheral surface of the lower belt 52 and a cross-sectional area of the heat sink 54 positioned inside the lower belt 52 is also similar to the above-described relationship, so that a space in the lower belt 52 cannot be efficiently used.

Here, the cross-sectional area refers to an area in a cross-sectional view of the cooling device 50 as seen in a plane which passes through a center of a region in which the sheet is capable of being fed with respect to a rotational axis direction of the driving roller 56*a* of the lower belt 52 and which is perpendicular to a rotational axis of the driving roller 56*a*. The cross-sectional area of the belt is an area in a belt locus in a state in which the lower belt 52 is stretched in this cross-sectional view. Further, in the structure of the reference example, a space in the upper belt 51 opposing the heat sink 54 in the lower belt 52 while sandwiching the nip N and a space in the lower belt 52 opposing the heat sink 53 in the upper belt 51 while sandwiching the nip N are dead spaces.

Therefore, in the cooling device 50 of this embodiment, in order to effectively utilize the dead spaces in FIG. 2, the heat dissipating portions 53*d* and 54*c* of the respective heat sinks 53 and 54 are provided in the spaces, so that heat dissipation efficiency of the respective heat sinks 53 and 54 are improved. The heat sink is improved in heat dissipation efficiency of the heat sink itself when the cross-sectional area of the heat dissipating portion becomes large, and therefore, a sheet cooling performance is improved.

Therefore, as shown in FIG. 1, only the heat dissipating portions 53*d* and 54*d* of the upper and lower heat sinks 53 and 54 are elongated and enlarged with respect to the sheet feeding direction a. These portions 53*d* and 54*d* are provided with stepped portions g for ensuring a space for being prevented from contacting the belts 51 and 52, respectively. The reason why the portions 53*d* and 54*d* are prevented from contacting the belts 51 and 52 is as described above.

In order to cause the upper and lower belts 51 and 52 to intimate contact each other, in the upper belt 51, at a position opposing the heat receiving portion 54*a* of the heat sink 54 in the lower belt 52, pressing rollers 60(*a, b*) are provided. The pressing rollers 60(*a, b*) press the upper belt 51 toward the lower belt 52. The stepped portion g of the heat sink 53 in the upper belt 51 is set so that the heat dissipating portion 53*d* does not contact the pressing rollers 60(*a, b*).

This is also ditto for the stepped portion g of the heat sink 54 in the lower belt 52. In the lower belt 52, at a position contacting the heat receiving portion 53*a* of the heat sink 53 in the upper belt 51, pressing rollers 59(*a, b*) for pressing the lower belt 52 toward the upper belt 51 are provided. The stepped portion g of the heat sink 54 in the lower belt 52 is set so that the heat dissipating portion 54*d* does not contact the pressing rollers 59(*a, b*). Specifically, outer diameters of the pressing rollers 59(*a, b*) and 60(*a, b*) are φ20 (mm), and therefore, each of the stepped portions g was 25 mm.

In this embodiment, the heat dissipating portions 53*d* and 54*d* which do not contact the belts 51 and 52 by providing the stepped portions g were 100 mm in length L with respect to the sheet feeding direction a.

Therefore, a total length of the heat dissipating portions of the heat sink 53 by the heat dissipating portions 53*c* and 53*d* is 200 mm with respect to the sheet feeding direction a. Assuming that peripheral lengths of the upper belts 51 in the reference example of FIG. 2 and in this embodiment of FIG. 1 are the same, 55% of the belt cross-sectional area was able to be occupied by the heat sink. That is, relative to the cross-sectional area of the heat dissipating portion 53*c* of the heat sink 53 in the structure shown in the reference view of FIG. 2, in the structure of this embodiment, it is possible to achieve the cross-sectional area which is about 2 times the cross-sectional area in the structure in the reference example.

Further, a total length of the heat dissipating portions of the heat sink 54 by the heat dissipating portions 54*c* and 54*d* is 200 mm with respect to the sheet feeding direction a. Assuming that peripheral lengths of the lower belts 52 in the reference example of FIG. 2 and in this embodiment of FIG. 1 are the same, 55% of the belt cross-sectional area was able to be occupied by the heat sink. That is, relative to the cross-sectional area of the heat dissipating portion 54*c* of the heat sink 54 in the structure shown in the reference view of FIG. 2, in the structure of this embodiment, it is possible to achieve the cross-sectional area which is about 2 times the cross-sectional area in the structure in the reference example.

As described above, when comparison is made in the case where sizes of the heat receiving portions of the heat sinks are the same, i.e., in the case where heat quantities received by the heat receiving portions are the same, heat can be dissipated quickly with a larger cross-sectional area of the heat dissipating portions. Accordingly, by providing the heat dissipating portions 53*d* and 54*d* which do not contact the belts 51 and 52 as in this embodiment, heat dissipation efficiency by the heat sinks 53 and 54 can be improved while effectively utilizing the regions in the belts 51 and 52.

Next, more preferable sizes of the heat dissipating portions 53*d* and 54*d* will be described. The heat dissipation efficiency can be more improved with larger sizes of the heat dissipating portions 53*d* and 54*d*. On the other hand, as regards the heat dissipating portions 53*d* and 54*d*, heat of the heat sources (heat receiving portions) 53*a* and 54*a* is not readily conducted as the heat dissipating portions 53*d* and 54*d* are more spaced from the heat sources (heat receiving portions) 53*a* and 54*a*, and therefore temperatures of the heat dissipating portions 53*d* and 54*d* at portions spaced from the heat sources (heat receiving portions) 53*a* and 54*a* lower. Accordingly, as the heat dissipating portions 53*d* and 54*d* are more spaced from the heat sources (heat receiving portions) 53*a* and 54*a*, a degree of contribution to improvement in heat dissipation efficiency of the heat sinks by providing the heat dissipating portions 53*d* and 54*d* lowers.

Figure 3:
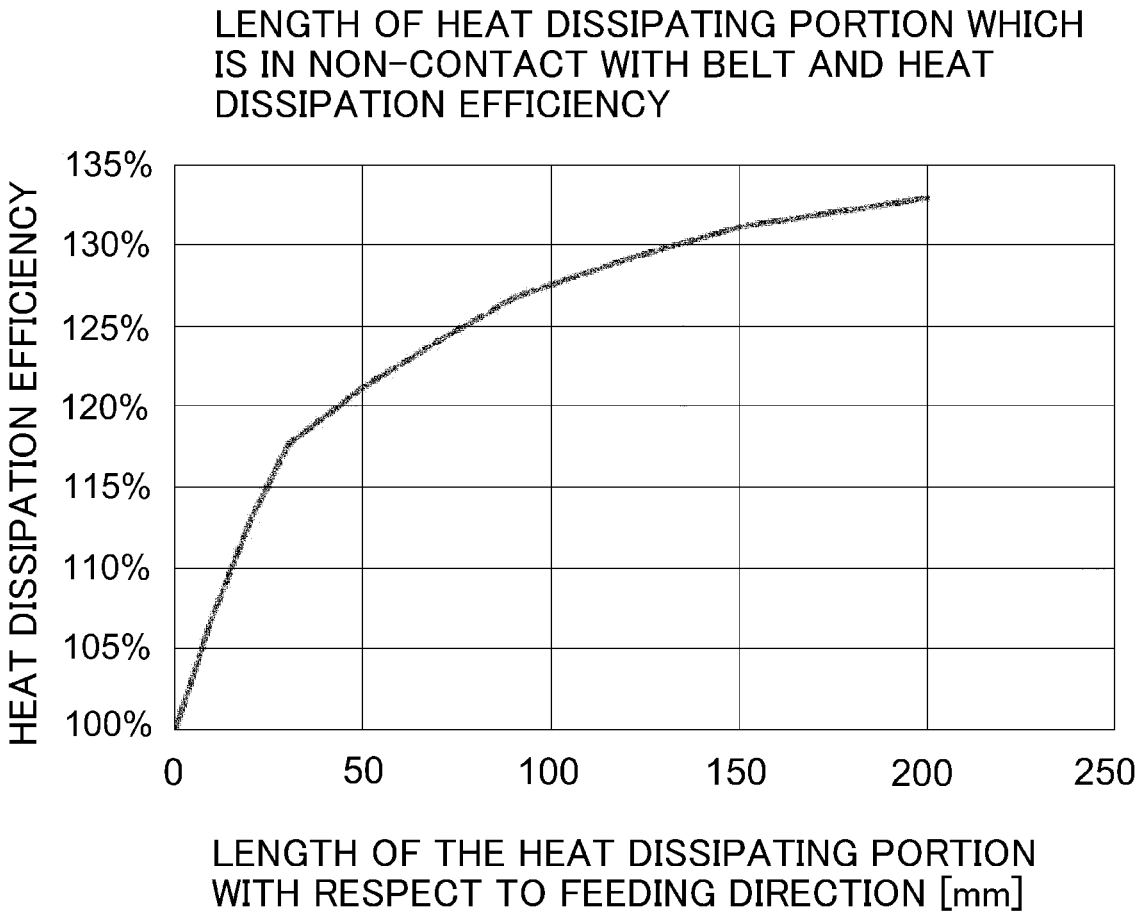
FIG. 3 is a graph of a distance from a heat source and heat dissipation efficiency.

FIG. 3 is a graph of a length (FIG. 1: L) of the heat dissipating portion 53*d* or 54*d* (the heat dissipating portion which does not contact the belt) with respect to the sheet feeding direction and the heat dissipation efficiency. As is understood also from this graph, the heat dissipation efficiency is not linearly improved when a heat dissipation area is increased, and even when the length of the heat dissipating portion 53*d* or 54*d* (the heat dissipating portion which does not contact the belt) with respect to the sheet feeding direction is increased to 100 mm or more, an increase in heat dissipation effect becomes small.

In this embodiment, L=100 mm is set, and therefore the heat dissipation efficiency of the heat sink is 127% (in the case where FIG. 2 is 100%) from FIG. 3, so that cooling power is improved. Further, the feeding direction length L of the heat dissipating portion 53*d* or 54*d* (the heat dissipating portion which is in non-contact with the belt) is set at about 10 mm and about 20 mm, from FIG. 3, the heat dissipation efficiency of the heat sink is about 105% and about 110%. Although an effect of improving the heat dissipation efficiency can be obtained even when the heat dissipation efficiency is 105% and 110%, the effect is still small, so that also with respect to the cross-sectional area of the belt, a space in which the heat sink is not mounted is large in size.

Therefore, in order to further improve effective utilization of the space in the belt and the heat dissipation efficiency of the heat sink, the heat dissipation efficiency of the heat sink may preferably be made 120% or more on the basis of FIG. 3. That is, at least the sheet feeding direction length L of the heat dissipating portion 53*d* or 54*d* (the heat dissipating portion which is in non-contact with the belt) is made a length of 50% or more of the sheet feeding direction length of the heat receiving portion 53*a* or 54*a* of the heat sink 53 or 54, respectively.

In other words, the length of the heat dissipating portions with respect to the sheet feeding direction by the heat dissipating portion 53*c* and the heat dissipating portion 53*d* in the heat sink 53 may preferably be 1.5 times the sheet feeding direction length of the heat receiving portion 53*a* (region where the heat receiving portion 53*a* contacts the inner peripheral surface of the upper belt 51 in the nip N) of the heat sink 53.

Here, the length of the heat receiving portion 53*a* refers to a length of the region contacting the upper belt 51 when the cooling device 50 is seen in a plane which passes through a center of a region, in which the sheet is capable of being fed in the nip N, with respect to the rotational axis direction of the driving roller 55*a* for the upper belt 51 and which is perpendicular to a rotational axis of the driving roller 55*a*. Further, the length of the heat dissipating portion refers to the longest length of the heat sink 53 when lengths of the heat dissipating portion 53*c* and the heat dissipating portion 53*d* are sequentially measured in a direction parallel to a lengthwise direction of the heat receiving portion 53*a* when the cooling device 50 is seen in the same plane.

Similarly, the length of the heat dissipating portions with respect to the sheet feeding direction by the heat dissipating portion 54*c* and the heat dissipating portion 54*d* in the heat sink 54 in the lower belt 52 may preferably be set in the following manner. That is, the heat dissipating portion length may preferably be made 1.5 times or more the sheet feeding direction length of the heat receiving portion 54*a* (region contacting the inner peripheral surface of the lower belt 52 in the nip N) of the heat sink 54.

Here, the length of the heat receiving portion 54*a* refers to a length of the region contacting the lower belt 52 when the cooling device 50 is seen in a plane which passes through a center of a region, in which the sheet is capable of being fed in the nip N, with respect to the rotational axis direction of the driving roller 56*a* for the lower belt 52 and which is perpendicular to a rotational axis of the driving roller 56*a*. Further, the length of the heat dissipating portion refers to the longest length of the heat sink 54 when lengths of the heat dissipating portion 54*c* and the heat dissipating portion 54*d* are sequentially measured in a direction parallel to a lengthwise direction of the heat receiving portion 54*a* when the cooling device 50 is seen in the same plane.

Specifically, in the structure of this embodiment, the heat sink 53 includes the heat receiving portion 53*a* of 100 mm in sheet feeding direction length, and therefore, the sheet feeding direction length L of the heat dissipating portion 53*d* is made 50 mm or more. Similarly, the heat sink 54 includes the heat receiving portion 54*a* of 100 mm in sheet feeding direction length, and therefore, the sheet feeding direction length L of the heat dissipating portion 54*d* is made 50 mm or more.

Further, as the heat dissipating portions 53*d* and 54*d* are made longer in the sheet feeding direction, the heat dissipation efficiency of the heat sinks 53 and 54 is improved, but the heat sinks 53 and 54 are upsized with respect to the sheet feeding direction. As described above, with an increasing distance of the heat dissipating portions 53*a* and 54*d* from the heat sources (heat receiving portions) 53*a* and 54*a*, the degree of contribution to improvement in heat dissipation efficiency lowers.

Accordingly, in order to suppress upsizing of the heat sink while more effectively improving the heat dissipation efficiency of the heat sink, the following constitution may preferably employed on the basis of FIG. 3. That is, at least the sheet feeding direction lengths L of the heat dissipating portions 53*d* and 54*d* (the heat dissipating portions which are in non-contact with the belts) of the heat sinks 53 and 54 are lengths of 50% or more and 100% or less of the sheet feeding direction lengths of the heat receiving portions 53*a* and 54*a* of the heat sinks 53 and 54.

In other words, the lengths of the heat dissipating portions with respect to the sheet feeding direction by the heat dissipating portion 53*c* and the heat dissipating portion 53*d* in the heat sink 53 may preferably be made 1.5 times or more and 2.0 times or less the sheet feeding direction length of the heat receiving portion 53*a* of the heat sink 53.

Similarly, the lengths of the heat dissipating portions with respect to the sheet feeding direction by the heat dissipating portion 54*c* and the heat dissipating portion 54*d* in the heat sink 54 in the lower belt 52 may preferably be made 1.5 times or more and 2.0 times or less the sheet feeding direction length of the heat receiving portion 54*a* of the heat sink 54.

In the constitution of this embodiment, the heat sink 53 includes the heat receiving portion 53*a* of 100 mm in the sheet feeding direction, and therefore the sheet feeding direction length L of the heat dissipating portion 53*d* may preferably be 50 mm or more and 200 mm or less. Similarly, the heat sink 54 includes the heat receiving portion 54*d* of 100 mm in the sheet feeding direction, and therefore the sheet feeding direction length L of the heat dissipating portion 54*d* may preferably be 50 mm or more and 200 mm or less.

The above-described characteristic constitutions are summarized as follows.

1) With respect to the sheet feeding direction a in the nip N, in the heat receiving portion 54*a* of the lower heat sink 54 in the opposite side through the upper and lower belts 51 and 52 in the section where the heat receiving portion 53*a* of the upper heat sink 53 contacts the inner surface of the upper belt 51, there is no heat receiving portion 54*a*.

2) The heat dissipating portions 53*c* and 53*d* of the upper heat sink 53 are longer than the heat receiving portion 53*a* with respect to the sheet feeding direction a, and the heat dissipating portions 54*c* and 54*d* of the lower heat sink 54 are longer than the heat receiving portion 54*a* with respect to the sheet feeding direction a.

3) the heat dissipating portions 53*c* and 53*d* of the upper heat sink 53 overlap with the heat receiving portion 54*a* of the lower heat sink 54 with respect to the sheet feeding direction a, and the heat dissipating portions 54*c* and 54*d* of the lower heat sink 54 overlap with the heat receiving portion 53*a* of the upper heat sink 53 with respect to the sheet feeding direction a.

4) Further, in the upper heat sink 53, at an overlapping portion where the heat dissipating portions 53*c* and 53*d* overlap with the heat receiving portion 54*a* of the lower heat sink 54, the heat dissipating portions 53*c* and 53*d* are provided with the stepped portion g relative to the heat receiving portion 53*a*. The stepped portion g is stepped in a direction of avoiding contact of the heat dissipating portions 53*c* and 53*d* with the heat receiving portion 54*a* of the lower heat sink 54 through the upper and lower belts 51 and 52.

5) Further, in the lower heat sink 54, at an overlapping portion where the heat dissipating portions 54*c* and 54*d* overlap with the heat receiving portion 53*a* of the upper heat sink 53, the heat dissipating portions 54*c* and 54*d* are provided with the stepped portion g relative to the heat receiving portion 54*a*. The stepped portion g is stepped in a direction of avoiding contact of the heat dissipating portions 54*c* and 54*d* with the heat receiving portion 53*a* of the upper heat sink 53 through the upper and lower belts 51 and 52.

By this embodiment, cooling efficiency of the cooling device is improved by improvement in heat dissipation efficiency of the heat dissipating portions relative to the heat receiving portion. By this, it becomes possible to meet reduction in cooling device size and speed-up through improvement in cooling performance of the cooling device while maintaining the size as it is.

Incidentally, as in the conventional constitution, in the constitution in which the heat dissipation efficiency is enhanced by using a cooling member through which a water pipe is passed and by disposing a radiator outside the cooling device, there is a need to provide the radiator, a pump, a tank and the like outside the cooling device, so that there was a liability that a total apparatus size increases. Further, a liquid is circulated by a cooling portion and the radiator, and therefore a point of liability such as leakage of the liquid is also added.

On the other hand, as shown in FIG. 2, in the case of the constitution in which the heat sinks provided inside the upper and lower belts are disposed and shifted simply in the feeding direction so as not to contact each other through the belts, as described above, the heat dissipation efficiency of the heat sink relative to the heat receiving portion lowers.

Further, in the case where the cooling nip is formed by shifting the heat sinks of FIG. 2 in the recording material feeding direction and by bringing the upper and lower heat sinks into contact with the inner peripheral surfaces of the respective belts in the same region with respect to the recording material feeding direction, the following problem arises. That is, in order to reliably contact the respective heat sinks to the rollers, surface accuracy of the nip surface of the heat sinks is required to be enhanced to a limit thereof. However, in this constitution, it is difficult to realize the enhancement from the viewpoint of processing accuracy.

Compared with these constitutions, the constitution of this embodiment is preferable in that an effect such as the cooling performance can be improved to the extent possible in the belt can be obtained.

That is, in the constitution in which the heat sinks are vertically disposed n the upper and lower belts, heat absorbing portions (contact portions) of the heat sinks are disposed by being shifted in the sheet feeding direction so as not to contact each other through the belts. On the other hand, heat discharging portions of the heat sinks are disposed and extended so as to overlap with the heat absorbing portions of the opposite-side heat sinks with respect to the feeding direction, whereby the heat dissipation efficiency of the heat sinks can be enhanced in the limited space in the belt cross section. By this, it becomes possible to meet downsizing and speed-up of the cooling device.

Incidentally, in this embodiment, in the upper-side heat sink 53, the constitution in which the heat receiving portion 53*a* is provided on an upstream side with respect to the sheet feeding direction was employed. The sheet is a high temperature at a surface on the side where unfixed toner images are fixed by the fixing device 17 immediately in front of the cooling device than at the back surface thereof. Therefore, in order to efficiently cool the sheet, a constitution in which the heat receiving portion provided on a most upstream side with respect to the sheet feeding direction is included in the heat sink 53 in the upper belt 51 may more preferably be employed. In this embodiment, the upper belt 51 is a belt for cooling the sheet while contacting the sheet surface on the side where the unfixed toner images were carried during introduction into the fixing device 17 immediately in front of the cooling device. However, a constitution in which the cooling device 50 of FIG. 4 is vertically reversed may also be employed.

Embodiment 2

This embodiment is similar to the embodiment 1 except for the cooling device, and therefore, in this section, only the cooling device will be described.

Figure 4:
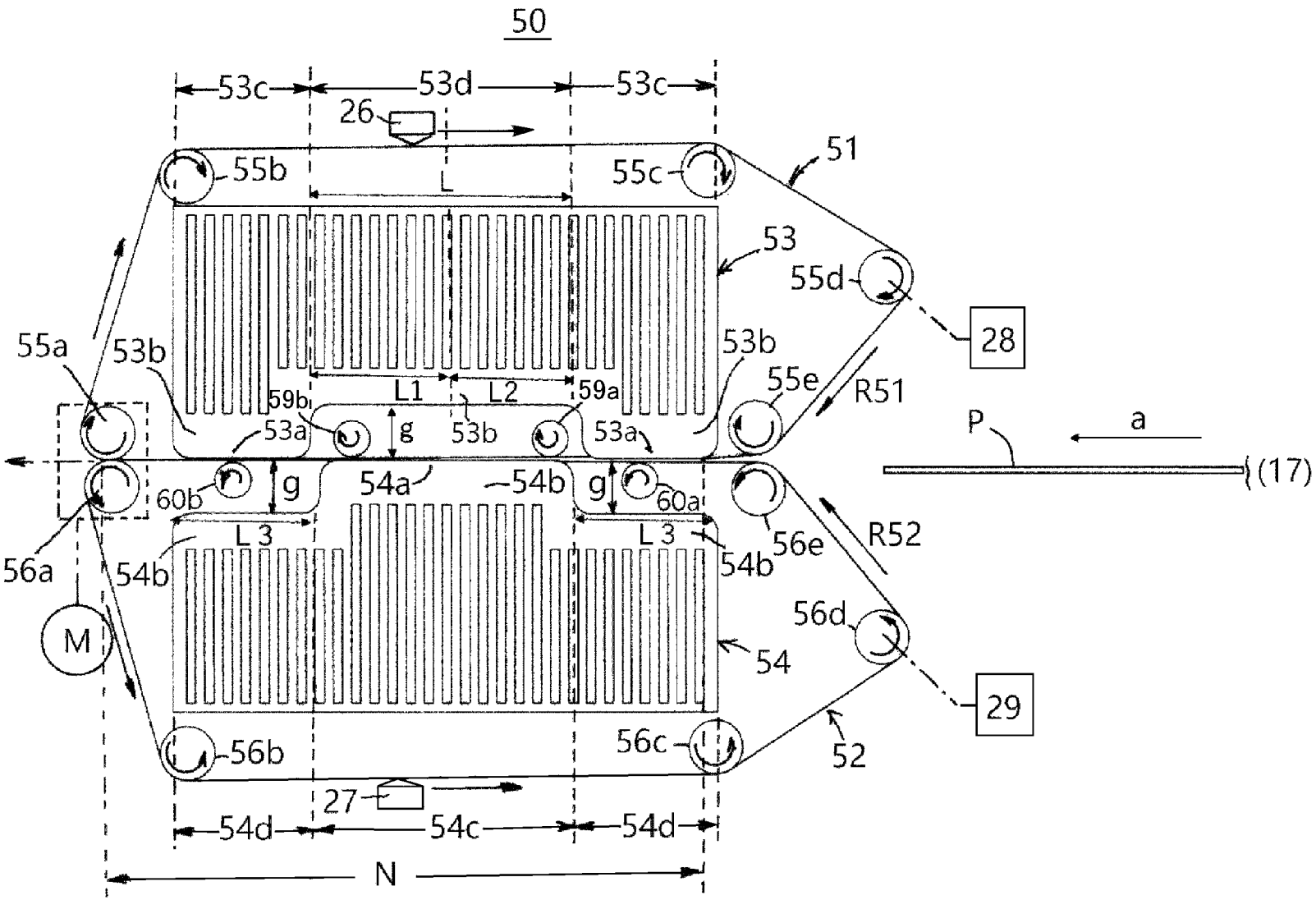
FIG. 4 is a structural illustration of a cooling device of an embodiment 2.

A cooling device structure in this embodiment 2 is shown in FIG. 4. The cooling device is similar to the cooling device of the embodiment 1 except for a shape of the heat sink, and therefore only the shape of the heat sink will be described.

Incidentally, the lengths relating to the heat receiving portion and the heat dissipating portions and the like and the cross-sectional areas of the belts and the heat sinks are lengths when the cooling device is seen in the cross section similar to the cross section defined in the embodiment 1. For example, as regards the upper belt, the lengths and the cross-sectional areas refer to respective lengths and respective cross-sectional areas, with respect to the rotational axis direction of the driving roller 55*a* of the upper belt 51, when the cooling device 50 is seen in a plane which passes through a center of a region where the sheet is capable of being fed in the nip N and which is perpendicular to a rotation shaft of the driving roller 55*a*. Specific defining methods (such as a length measuring method) are as described in the embodiment 1, and therefore, will be omitted from description.

The upper heat sink 53 on an inside of the upper belt 51 includes a plurality of heat receiving portions 53*a*. In this embodiment, the heat receiving portions 53*a* are provided at two positions on an upstream side and a downstream side with respect to the sheet feeding direction a, and therebetween, a heat dissipating portion 53*d* (heat dissipating portion which is in non-contact with the belt 51) including the stepped portion g. The sheet feeding direction length of the upstream-side heat receiving portion 53*a* was set at 50 mm, the sheet feeding direction length of the downstream-surface heat receiving portion 53*a* was set at 50 mm, and the sheet feeding direction length L of the heat dissipating portion 53*d* was set at 100 mm.

Here, the heat dissipation efficiency of the heat dissipating portion 53*d* is determined by a distance from the heat sources (heat receiving portions 53*a*). In this embodiment, the heat receiving portions 53*a* of the upper heat sink 53 are provided at the two positions on the upstream side and the downstream side with respect to the sheet feeding direction a relative to the heat dissipating portion 53*d*, and therefore, a distance between each heat source (heat receiving portion 53*a*) and the heat dissipating portion 53*d* becomes nearer than in the case of the embodiment 1.

In the upper and lower heat sinks 53 and 54 in the embodiment 1, the sheet feeding direction lengths L of the heat dissipating portions 53*d* and 54*d* which are in non-contact with the upper and lower belts 51 and 52 are 100 mm. Also in this embodiment, the sheet feeding direction length L of the heat dissipating portion 53*d*, which is in non-contact with the belt 51, of the upper heat sink 53 is 100 mm. However, the heat receiving portion 53*a* of the upper heat sink 53 is divided into the upstream and downstream portions with respect to the sheet feeding direction a, whereby remotest distances L1 and L2 from the heat receiving portions 53*a* with respect to the sheet feeding direction are each half of the length L of the heat dissipating portion 53*a*, so that L1=L2=50 mm holds.

As shown in FIG. 3, with an increasing distance from the heat source, an increase in heat dissipation efficiency of the heat sink becomes insensitive. The reason for this is that when a temperature of the fin base 53*b* lowers, a difference between itself and an ambient temperature becomes small, so that the heat dissipation efficiency lowers.

In this embodiment 2, sizes of the heat dissipating portions 53*c* and 53*d* of the upper heat sink 53 are similar to those in the embodiment 1, but the distance from the heat source is short, and therefore, the temperature of the fin base 53*b* can be maintained at a higher temperature. From FIG. 3, the heat dissipation efficiency is 122% when the sheet feeding direction lengths L1 and L2 from the heat receiving portions, and this is acquired at two positions, so that compared with the heat sink of a comparison example of FIG. 2, the heat dissipation efficiency can be improved to about 140%.

Further, the lower heat sink 54 provided inside the lower belt 52 is also similar to the above, and the heat receiving portion 54*a* is provided at one position, but the heat receiving portion 54*a* is disposed a central portion of the lower heat sink 54 and the heat dissipating portion 54*d* which is in non-contact with the belt 52 and which includes the stepped portion g is disposed on the upstream side and on the downstream side. By this, the sheet feeding direction length L3 of the heat dissipating portion 54*d* is reduced to 50 mm while avoiding contact with the upper heat sink 53 on the inside of the opposite-side upper belt 51. Therefore, also the lower heat sink 54 was improved in heat dissipation efficiency by 40% similarly as the upper heat sink 53.

As in this embodiment, at least one of the upper and lower heat sinks may more preferably be arranged so that when the heat sink(s) is (are) seen in the sheet feeding direction, the heat receiving portion 53*a*, the heat dissipating portion 53*d* (region where the portion is in non-contact with the belt), and the heat receiving portion 53*a* are repeated in the named order.

Incidentally, in this embodiment, the reason why the heat dissipating portion 53*d* does not contact the belt in the nip N is that the heat receiving portion 54*a* of the heat sink 54 in the lower belt 52 and the heat sink in the upper belt 51 are prevented from sandwiching the upper and lower belts 51 and 52. Therefore, when the cooling device 50 is seen in the sheet feeding direction, a predetermined clearance (for example, 2 mm or more) may preferably be provided between the upstream-side heat receiving portion 53*a* and the heat receiving portion 54*a* and between the heat receiving portion 54*a* and the downstream-side heat receiving portion 53*a*, similarly as in the FIG. 1.

Further, similarly as in the embodiment 1, as a more preferable constitution, the length of the heat dissipating portions with respect to the sheet feeding direction by the heat dissipating portion 53*c* and the heat dissipating portion 53*d* in the heat sink 53 may preferably be 1.5 times or more the sheet feeding direction length of the heat receiving portion 53*a* of the heat sink 53. Further, more preferably, the length of the heat dissipating portions with respect to the sheet feeding direction may be made 1.5 times or more and 2.0 times or less the sheet feeding direction length of the heat receiving portion 53*a* of the heat sink 53.

Here, in the case where the heat dissipating portion 53*c* is divided into a plurality of portions when the cooling device 50 is seen in the sheet feeding direction as shown in FIG. 4, the length of the heat dissipating portions includes lengths of all the heat dissipating portions 53*c* (two portions in FIG. 4) in the heat sink 53. Similarly, in the case where the heat receiving portion 53*a* is divided into a plurality of portions when the cooling device 50 is seen in the sheet feeding direction as shown in FIG. 4, the length of the heat receiving portions includes lengths of all the heat receiving portions 53*a* (two portions of FIG. 4) in the heat sink 53.

Similarly, the length of the heat dissipating portions with respect to the sheet feeding direction by the heat dissipating portion 54*c* and the heat dissipating portion 54*d* in the heat sink 54 in the lower belt 52 may preferably be set in the following manner. That is, the heat dissipating portion length may preferably be made 1.5 times or more the sheet feeding direction length of the heat receiving portion 54*a* (region contacting the inner peripheral surface of the lower belt 52 in the nip N) of the heat sink 54.

Further, more preferably, the length of the heat dissipating portions with respect to the sheet feeding direction may be made 1.5 times or more and 2.0 times or less the sheet feeding direction length of the heat receiving portion 54*a* of the heat sink 54. Here, in the case where the heat dissipating portion 54*d* is divided into a plurality of portions when the cooling device 50 is seen in the sheet feeding direction, the length of the heat dissipating portions includes lengths of all the heat dissipating portions 54*d* (two portions in FIG. 4) in the heat sink 54.

Incidentally, in this embodiment, in the upper-side heat sink 53, the constitution in which the heat receiving portion 53*a* is divided into the plurality of portions when the cooling device 50 is seen in the sheet feeding direction was employed. The sheet is a high temperature at a surface on the side where unfixed toner images are fixed by the fixing device 17 immediately in front of the cooling device than at the back surface thereof. Therefore, in order to efficiently cool the sheet, a constitution in which the heat receiving portion provided on a most upstream side with respect to the sheet feeding direction is included in the heat sink 53 in the upper belt 51 may more preferably be employed.

In this embodiment, the upper belt 51 is a belt for cooling the sheet while contacting the sheet surface on the side where the unfixed toner images were carried during introduction into the fixing device 17 immediately in front of the cooling device. However, a constitution in which the heat receiving portion 54*a* on the lower side is divided into a plurality of portions when the cooling device 50 is seen in the sheet feeding direction may also be employed. That is, a constitution in which the cooling device 50 of FIG. 4 is vertically reversed may also be employed.

Therefore, by this embodiment, the heat dissipation performance is remarkably improved, and it is effective in downsizing and improvement in productivity of the cooling device.

<<Other Matters>>

1) The heat dissipating portions 53*c*, 53*d*, 54*c* and 54*d* of the cooling members 53 and 54 are not limited to the heat sinks but may also be heat pipes or the like.

2) The fixing device 17 as the image heating portion is not limited to a fixing device of the heating roller type in the embodiments. It is possible to use fixing devices of heating types, in conventionally known various constitutions, such as a heat chamber type, an infrared irradiation type and an electrophotographic heating type.

3) Further, the image heating portion is not limited to the fixing device. The image heating portion may also be a glossiness increasing device (image modifying device: in this case, the device is called the fixing device) for increasing glossiness of the image by heating the image fixed on the recording material.

4) The image forming portion of the image forming apparatus is not limited to an image forming portion of the electrophotographic type. The image forming portion may also be of an electrostatic recording type or a magnetic recording type. Further, the transfer type is not limited to the above-described transfer type, but the image forming apparatus may also have a constitution in which an unfixed image is formed on the recording material in a direct (transfer) type.

5) In the embodiments, an example in which the present invention is applied to the full-color image forming apparatus of the electrophotographic type including the plurality of photosensitive drums is described, but the present invention is not limited thereto and can also be applied to image forming apparatuses of various types, a monochromatic (single-color) image forming apparatus and the like.

INDUSTRIAL APPLICABILITY

According to the present invention, the recording material cooling device capable of effectively utilizing the spaces in the belts forming the nip in which the recording material is cooled.

The present invention is not restricted to the above-described embodiments, but can be variously changed and modified without departing from the spirit and scope of the present invention. Accordingly, the following claims are annexed in order to make the scope of the present invention public.

The invention claimed is:

1. A cooling device for cooling a recording material on which a toner image is fixed, the cooling device comprising:

a first belt;

a second belt for forming a nip in which the recording material is nipped and fed in cooperation with said first belt;

a first cooling unit provided inside said first belt and including (1) a first heat receiving portion for receiving heat in contact with an inner surface of said first belt in the nip and (2) a first heat dissipating portion for dissipating the heat; and a second cooling unit provided inside said second belt and including (1) a second heat receiving portion for receiving heat in contact with an inner surface of said second belt at a downstream side of said first heat receiving portion with respect to a recording material feeding direction and (2) a second heat dissipating portion for dissipating the heat, wherein said first heat dissipating portion is longer than said first heat receiving portion with respect to the recording material feeding direction, wherein said first heat dissipating portion includes an overlapping portion where said first heat dissipating portion overlaps with said second heat receiving portion with respect to the recording material feeding direction, and wherein said overlapping portion (1) does not contact the inner surface of said first belt and (2) opposes the inner surface of said first belt.

2. The cooling device according to claim 1, wherein said first cooling unit includes a stepped portion between said overlapping portion and said first heat receiving portion with respect to the recording material feeding direction.

3. The cooling device according to claim 1, wherein with respect to the recording material feeding direction, said first heat dissipating portion is 1.5 times or more longer than said first heat receiving portion.

4. The cooling device according to claim 1, wherein said first cooling unit includes a plurality of said first heat receiving portions connected to said first heat dissipating portion.

5. The cooling device according to claim 1, wherein said first heat dissipating portion and said second heat dissipating portion are heat sinks and dissipate the heat by fans.

6. The cooling device according to claim 1, further comprising a pressing roller for forming the nip through said first belt and said second belt in cooperation with said second heat receiving portion, wherein said pressing roller is provided between said overlapping portion and said first belt with respect to a thickness direction of the recording material nipped by the nip.

7. The cooling device according to claim 1, wherein said second heat dissipating portion is longer than said second heat receiving portion with respect to the recording material feeding direction, wherein said second heat dissipating portion includes another overlapping portion where said second heat dissipating portion overlaps with said first heat receiving portion with respect to the recording material feeding direction, and wherein said another overlapping portion opposes the inner surface of said second belt.

8. The cooling device according to claim 7, wherein said second cooling unit includes another stepped portion between said another overlapping portion and said second heat receiving portion.

9. The cooling device according to claim 7, wherein with respect to the recording material feeding direction, said second heat dissipating portion is 1.5 times or more longer than said second heat receiving portion.

10. The cooling device according to claim 7, further comprising another pressing roller for forming the nip through said first belt and said second belt in cooperation with said first heat receiving portion, wherein said another pressing roller is provided between said another overlapping portion and said second belt with respect to a thickness direction of the recording material nipped by the nip.

11. A cooling device for cooling a recording material on which a toner image is fixed, the cooling device comprising:

a first belt;

a second belt for forming a nip in which the recording material is nipped and fed in cooperation with said first belt;

a first cooling unit provided inside said first belt and including (1) a first heat receiving portion for receiving heat in contact with an inner surface of said first belt in the nip and (2) a first heat dissipating portion, provided at an opposite side of said first heat receiving portion, for dissipating the heat; and a second cooling unit provided inside said second belt and including (1) a second heat receiving portion for receiving heat in contact with an inner surface of said second belt at a downstream side of said first heat receiving portion with respect to a recording material feeding direction and (2) a second heat dissipating portion, provided at an opposite side of said second heat receiving portion, for dissipating the heat, wherein said first heat dissipating portion is longer than said first heat receiving portion with respect to the recording material feeding direction, wherein said first heat dissipating portion overlaps with said second heat receiving portion with respect to the recording material feeding direction, and wherein said second heat dissipating portion overlaps with said first heat receiving portion with respect to the recording material feeding direction.

* * * * *